US007721913B2

(12) United States Patent
Nash et al.

(10) Patent No.: US 7,721,913 B2
(45) Date of Patent: May 25, 2010

(54) DISPENSER FOR REPOSITIONABLE NOTES

(75) Inventors: James E. Nash, Bloomington, MN (US); Peter J. Newbould, Milan (IT); Ivana Babic, Milan (IT)

(73) Assignee: 3M Innovative Properties Company, St. Paul, MN (US)

( * ) Notice: Subject to any disclaimer, the term of this patent is extended or adjusted under 35 U.S.C. 154(b) by 1 day.

(21) Appl. No.: 11/538,973

(22) Filed: Oct. 5, 2006

(65) Prior Publication Data

US 2008/0083771 A1 Apr. 10, 2008

(51) Int. Cl.
*B65H 1/08* (2006.01)

(52) U.S. Cl. ..... 221/60; 221/56; 221/59; 221/58; 221/36; 221/45

(58) Field of Classification Search ..... 221/1–312 C
See application file for complete search history.

(56) References Cited

U.S. PATENT DOCUMENTS

| | | | | | |
|---|---|---|---|---|---|
| 2,640,587 | A | * | 6/1953 | Smith | 206/37 |
| 3,606,080 | A | * | 9/1971 | Lynch et al. | 221/63 |
| 3,606,082 | A | * | 9/1971 | Kuchenbecker | 221/52 |
| 3,982,659 | A | * | 9/1976 | Ross | 221/63 |
| 4,796,781 | A | | 1/1989 | Windorski | |
| 4,921,127 | A | | 5/1990 | Windorski | |
| D310,243 | S | | 8/1990 | Evenson | |
| 4,986,440 | A | | 1/1991 | Windorski | |
| 4,993,590 | A | | 2/1991 | Windorski | |
| 5,067,628 | A | | 11/1991 | Evenson | |
| 5,080,255 | A | | 1/1992 | Windorski | |
| 5,143,250 | A | * | 9/1992 | Freitag | 221/59 |
| 5,158,205 | A | | 10/1992 | Bodziak et al. | |
| D331,075 | S | | 11/1992 | Dotterman et al. | |
| 5,165,570 | A | | 11/1992 | Windorski | |
| 5,167,346 | A | * | 12/1992 | Bodziak | 221/63 |
| D332,889 | S | | 2/1993 | Hines | |
| D339,823 | S | | 9/1993 | Evenson | |
| 5,271,522 | A | * | 12/1993 | Ko et al. | 221/58 |
| 5,363,985 | A | * | 11/1994 | Cornell | 221/46 |
| D357,938 | S | | 5/1995 | Wolff | |
| 5,415,320 | A | * | 5/1995 | North et al. | 221/63 |
| 5,417,345 | A | | 5/1995 | Smith | |
| D365,482 | S | | 12/1995 | Larimore | |
| 5,480,060 | A | * | 1/1996 | Blythe | 221/63 |
| 5,526,955 | A | | 6/1996 | Windorski et al. | |
| 5,671,866 | A | | 9/1997 | Bodziak | |
| D419,601 | S | | 1/2000 | Windorski | |
| 6,068,138 | A | | 5/2000 | Carlson et al. | |
| D428,926 | S | | 8/2000 | Windorski | |
| 6,318,590 | B1 | * | 11/2001 | McMurray-Stivers | 221/45 |
| 6,523,714 | B2 | * | 2/2003 | Serbiak | 221/45 |
| 6,595,387 | B1 | | 7/2003 | Zimmermann et al. | |
| 6,688,488 | B2 | | 2/2004 | Bailey | |
| 6,702,147 | B2 | * | 3/2004 | Ashford | 221/34 |

(Continued)

*Primary Examiner*—Gene Crawford
*Assistant Examiner*—Michael K Collins
(74) *Attorney, Agent, or Firm*—Robert H. Jordan

(57) ABSTRACT

A dispenser for a pad of repositionable notes is provided. The dispenser includes (a) a base having opposing interior and exterior surfaces; (b) a cover having opposing interior and exterior surfaces and two slots disposed substantially orthogonal to one another, the slots being sized to allow for dispensing individual repositionable notes from the pad, the cover disposed on the base forming a cavity; and (c) a biasing mechanism disposed in the cavity.

21 Claims, 5 Drawing Sheets

U.S. PATENT DOCUMENTS 6,749,084 B2 * 6/2004 Thompson ..... 221/56
7,051,899 B1 * 5/2006 Offenhauer et al. ..... 221/124
7,178,689 B2 * 2/2007 Wieser et al. ..... 221/52

* cited by examiner

DISPENSER FOR REPOSITIONABLE NOTES

FIELD OF INVENTION

The present invention relates to a dispenser for repositionable notes having a cover and a base forming a housing. In particular, the present invention relates to a dispenser where the cover includes two slots disposed substantially orthogonal to each other.

BACKGROUND

Repositionable paper notes are used widely today. Some notes are assembled in a z-stacked (also referred to as "fan fold") construction. In such a construction, the note, typically square, but can also be rectangular, or special die cut shaped, has opposing front and back surfaces. On the back surface, along an edge or region of the note is a stripe of repositionable adhesive. The front of the note may contain a release coating. The notes are stacked so that the adhesive stripe of each note is positioned on alternating ends of the pad of notes. The pad also includes a bottommost sheet that protects the last repositionable note in the pad. Commercially available pads of z-stacked repositionable notes are available from 3M Company under the Post-It® brand, such as Post-It® Pop-up Notes.

There are a wide variety of dispensers for pads of repositionable notes. Examples of commercially available dispensers include those from 3M Company, St. Paul, Minn., such as, the Designer Series Pop-Up Notes Dispenser, DS440-VP or DS330-VA for 4 by 4 inch or 3 by 3 inch notes respectively, the Professional Design Pop-Up Notes Dispenser, PRO440-VP or PRO330 for 4 by 4 inch or 3 by 3 inch notes respectively. 3M also offers a Professional Design Pop-Up Dispenser PRO331-RB for 3 by 3 inch note with a pen holder where the dispenser is mountable on a vertical surface. These dispensers offer attractive designs and are functional.

There is a continuing need for different dispensers for the market place.

SUMMARY

In one aspect, the present invention pertains to dispenser for a pad of repositionable notes. The dispenser comprises a base having opposing interior and exterior surfaces; a cover having opposing interior and exterior surfaces and two slots disposed substantially orthogonally to one another, the slots being sized to accommodate the repositionable notes, the cover disposed on the base forming a cavity; and a biasing mechanism disposed inside the cavity. The two slots are sometimes referred to as a cross-slot. The dispenser is preferably used with a pad of z-stacked repositionable notes. Optionally, the dispenser also comprises means for latching, and if desired, for securing the cover and the base.

In another aspect, the present invention pertains to a dispenser for a pad of repositionable notes comprising (i) a housing comprising a cover and a base, the cover comprising two slots disposed substantially orthogonal to one another, the slots being sized to allow for dispensing the notes, and (ii) means for biasing the pad against the cover; the means for biasing the pad disposed inside the housing.

An advantage of the present invention is that there exists no preferred orientation to install the cover on to the base. Thus, the user is unlikely to make an error in the assembly process. The dispenser is particularly suited for display on a vertical surface, such as a wall.

Another advantage of the present invention is that because of the cross-slots, the pad can be installed into the dispenser in two orientations and the dispenser remains operational.

In this document, all numerical values are presumed to be modified by the term "about."

BRIEF DESCRIPTION OF THE DRAWINGS

The present invention can be further described with reference to the following drawings, wherein.

These figures are idealized, are not drawn to scale, and are intended merely for illustrative purposes.

DETAILED DESCRIPTION

Figure 1:
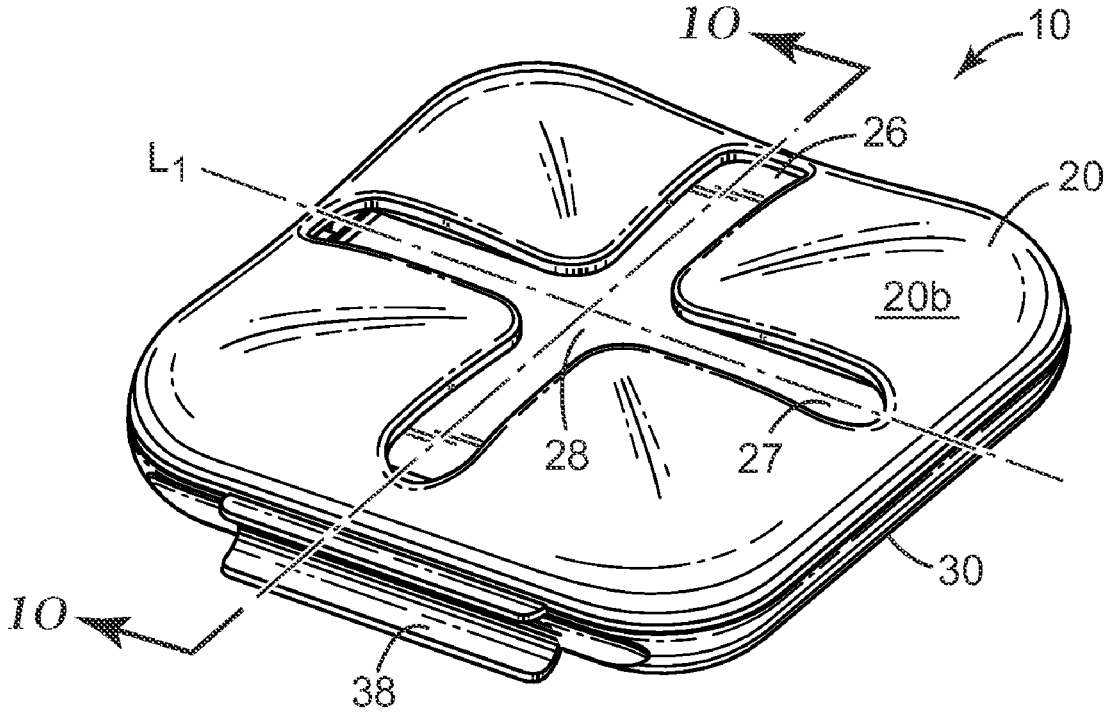
FIG. 1 is a perspective view of an exemplary embodiment of the present invention.

FIG. 1 shows a perspective view of an exemplary dispenser 10 having cover 20 and base 30. The shape of the cover and the base are substantially the same. When assembled together, they form a cavity or a housing where a pad of repositionable notes can be installed for dispensing. In this embodiment, the cover and base have a substantially square geometry with rounded corners. Other geometries can be used, such as, without limitation, triangles, pentagons, hexagons, heptagons, octagons, and the like. Non-polygon shaped geometries can be used as well, such as, without limitation, circles. With the polygons, preferably the sides are substantially equal to one another so that any rotation of the cover with respect to the base does not alter their assembly. That is, in the present invention, the cover and the base are designed with no particular alignment of one with respect to the other. The cover includes first slot 26 and second slot 27 that intersect each other at about their respective midpoints, denoted as reference number 28. The slots are disposed substantially orthogonally to one another forming a cross-slot. The slots create opening in the cover for dispensing of a repositionable note, as further explained below. The dispenser also includes optional utensil holding device 38. The dispenser has a major axis, denoted as line $L_1$, disposed generally parallel to one of the two slots. The major axis also lies parallel to an uppermost sheet of a pad of repositionable notes once installed in the dispenser. The exterior surface of the cover is denoted as reference number 20*b*.

In one application, a pad of fan-fold repositionable notes is installed in the dispenser such that the adhesive stripes of the notes lie generally parallel to slot 26. In another application, the pad is installed such that the adhesive stripes of the notes lie generally parallel to slot 27.

Figure 2:
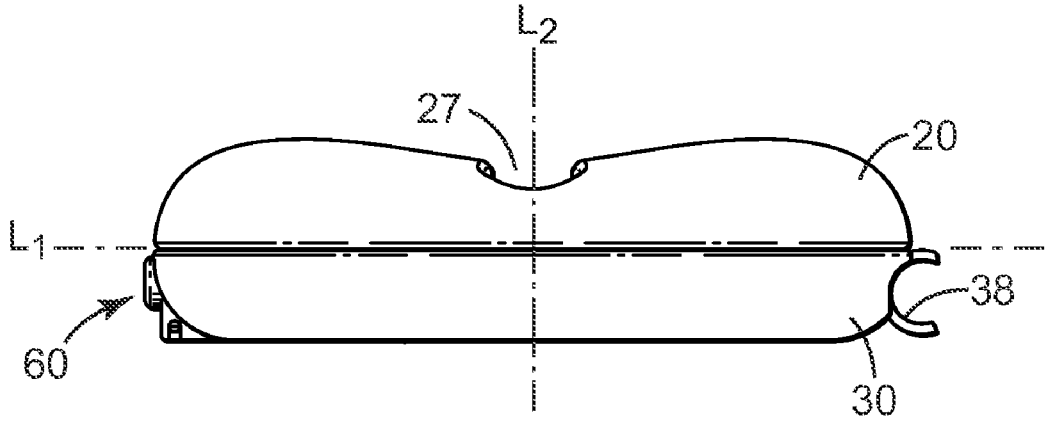
FIG. 2 is a side view of the embodiment of FIG. 1.

FIG. 2 shows a side view of the dispenser of FIG. 1. This view makes clear that the utensil holding device extends from the base, although the device may extend from the cover, if desired. Reference line $L_2$ denotes a minor axis of the dispenser disposed orthogonal to the major axis $L_1$. The dispenser further includes spring-loaded tab 60 disposed on one side of the base. As further explained below, the spring-loaded tab provides a mechanism for convenient assembly and disassembly of the cover from the base. While the spring-loaded tab is shown to be on the side opposite of the utensil holding device, it may be positioned on the either of the two sides adjacent to the side containing the utensil holding device. An attachment mechanism 70 lies proximate to the exterior surface of the base. The attachment mechanism extends from the spring-loaded tab towards the utensil holding device. As can be seen, the cover is curved from its edge towards its center approaching the slots.

Figure 3:
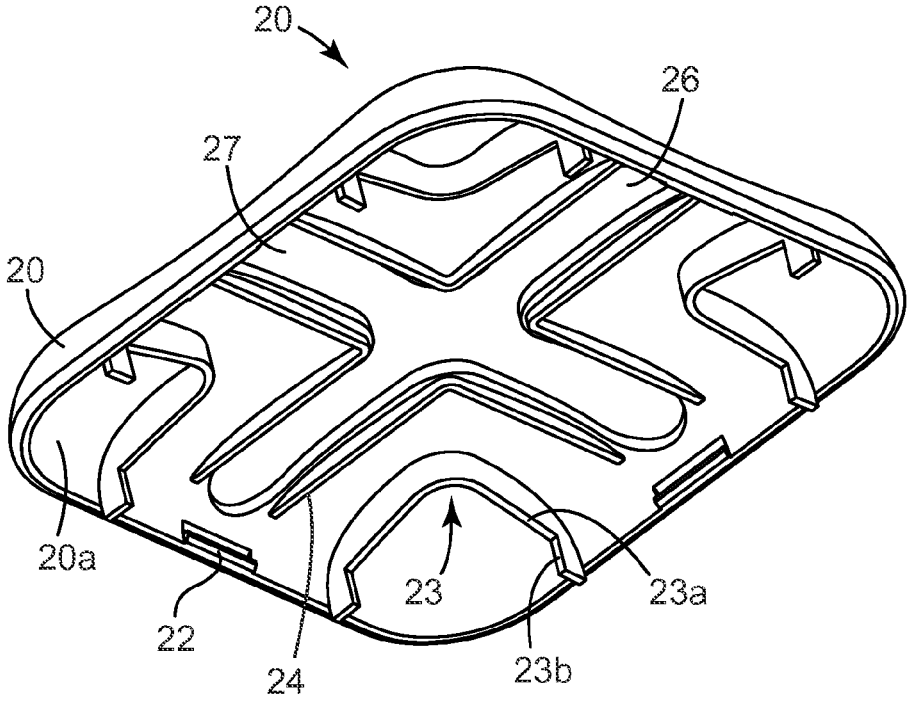
FIG. 3 is a perspective view of an exemplary cover for use in the present invention.

FIG. 3 shows a perspective view of the cover of dispenser of FIG. 1 looking primarily at its interior surface 20*a*. The cover includes a plurality of optional spacers 23, each having sheet contacting zone 23*a* disposed between two retainers 23*b*. The retainers lie substantially parallel to the minor axis of the dispenser. In this particular embodiment, four spacers are used and are positioned generally at the rounded corners of the substantially square shaped dispenser. In use, once the dispenser has been assembled with a pad of repositionable notes (not shown) disposed in the cavity, the uppermost repositionable note of the pad contacts the sheet contacting zone on the spacers and the retainers generally contact the side of the pad minimizing its movement along the major axis of the dispenser during the dispensing. The cover further includes ribs 24 extending from the interior surface of the cover and tracing nearly the entire length of the perimeter of the two slots. In this particular embodiment, the ribs do not trace the rounded ends of the slots. The cover further includes a plurality of notches 22, which forms a part of the latching mechanism. The notches are located on the edge of the cover approximately at the midpoint of the each side.

Figure 4:
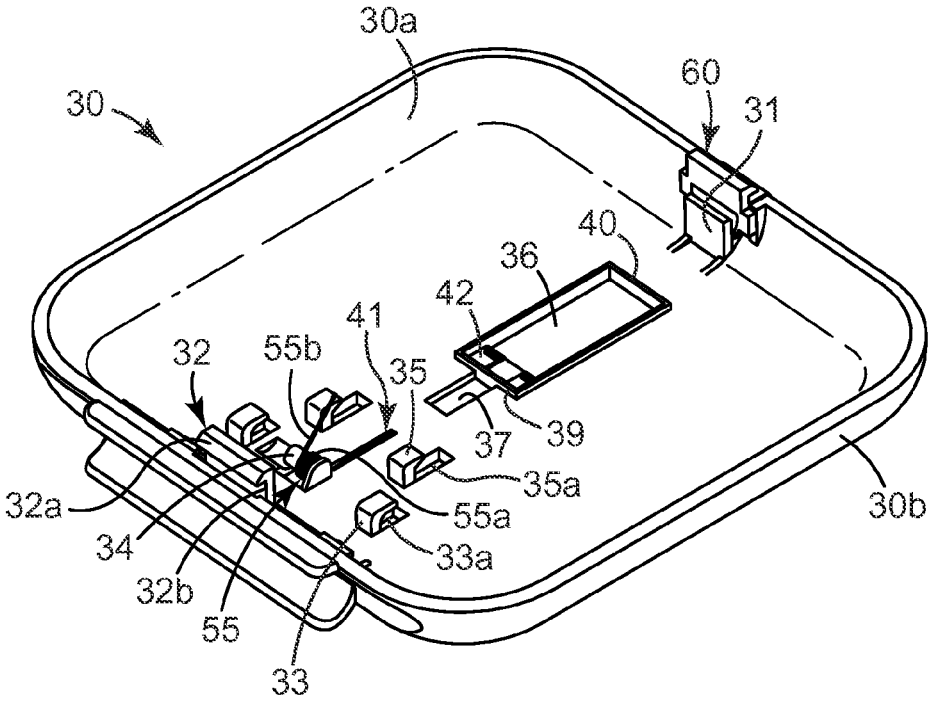
FIG. 4 is a perspective view of an exemplary base for use in the present invention.

FIG. 4 shows a perspective view of the base 30 of FIG. 1 as viewed primarily from its interior surface 30*a*. The base includes a tab 32 that cooperates with the notches of the cover to form a latching mechanism. The tab has a prong section 32*a* extending from a body section 32*b*. During assembly, the prong section of the tab in the base mate with the notches of the cover thereby latching the two components together. In this embodiment, two tabs are disposed at the midpoint on opposing sides of the base. In this way, the cover can be rotated up to 360° from its initial position with respect to the base, in 90° increments, and latching mechanism enables the assembly of the two. For ease of disassembly, one of the tabs, denoted as reference number 60, is a spring-loaded tab. The spring loaded tab functions in cooperation with a stop 31 extending from the interior surface of the base. By pushing into the spring-loaded tab (i.e., towards the cavity and into the stop), a user is able to lift one side of the cover off of the base to initiate the disassembly of the dispenser to, e.g., reload it with another pad of repositionable notes. The base also includes a primary arm 33, with its associated opening 32*a*, and a secondary arm 35, with its associated opening 35*a*, that cooperates with a paddle of a biasing mechanism, as discussed in detail below. In this particular embodiment, two primary arms and two secondary arms are used.

Disposed between the two primary arms is a spindle 34 having a torsion spring 55 attached. As further explained below, the torsion spring is a component of the biasing mechanism. The torsion spring includes a coil portion 55*a* having opposing first and second ends. The torsion spring further includes first and second tangs 55*b* extending from the first and second end of the coil portion respectively. In use, once assembled, one of the tangs lies in a first groove 41 located on the interior surface of the base. The other tang would be in contact with a second groove located on a bottom surface of the paddle of the biasing mechanism. The combination of the first and second grooves keeps the torsion spring stationary during use.

The base optionally includes a utensil holding device 38 disposed on its exterior surface and along one side. If desired, a plurality of utensil holding devices can be added to the base. The utensil holding device has an arcuate surface that would provide interference fit with a writing utensil (not shown). While FIG. 4 shows the tab 32 disposed on the same edge of the base as the utensil holding device, the two can be on separate sides of the dispenser if desired. Optionally, the base includes a first aperture 36 that cooperates with an attachment mechanism thereby allowing the dispenser to be conveniently mounted to and removed from a display surface. The first aperture has opposing first and second walls, 39 and 40 respectively, that define its length. Extending from the first wall into the first opening towards the second wall is a protrusion 42 that cooperates with the attachment assembly. The base further includes an optional second aperture 37 disposed adjacent to the first aperture. The cooperation of the attachment mechanism with the first and second apertures is discussed further below with reference to FIG. 7.

Figure 5:
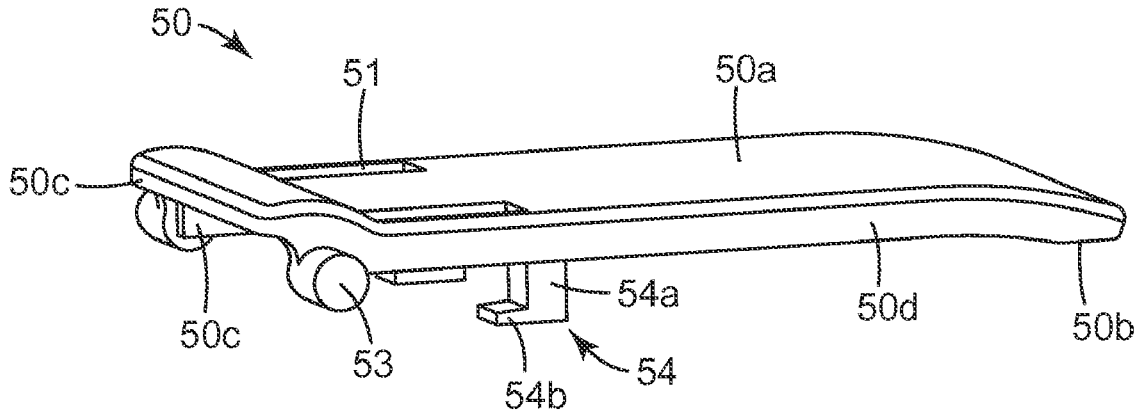
FIG. 5 is a perspective view of an exemplary biasing mechanism for use in the present invention.

FIG. 5 shows a perspective view of an exemplary embodiment of a paddle 50 that can be used in cooperation the torsion spring to form the biasing mechanism, which is located inside the cavity formed when the cover and base are assembled together. The paddle is generally an elongated structure having opposing pad contacting surface 50*a* and bottom surface 50*b* being bound by two substantially parallel side walls 50*d*, 50*e*. Extension 53 extends from the side edge near a first end 50*c* of the paddle. This particular embodiment uses two extensions, each being generally circular in its cross section. The paddle also includes a distance-controlling unit 54 that cooperates with the second arm of the base to limit the travel distance of the paddle. The distance-controlling unit includes a leg 54*a* extending from the bottom surface of the paddle and a foot 54*b* extending from a distal end of the leg. The leg is elongated and has a substantially straight front surface facing toward the extension. In one embodiment, two distance-controlling units are used. The paddle further includes opening 51 that cooperates with the secondary arm of the base.

Figure 6:
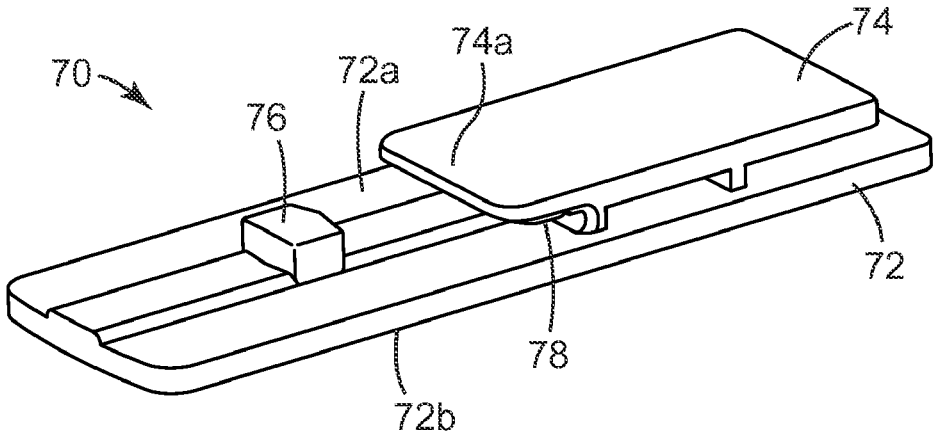
FIG. 6 is a perspective view of an exemplary attachment mechanism for use in the present invention.

FIG. 6 shows a perspective view of an exemplary embodiment of an attachment mechanism 70 that can be used in cooperation with the base to allow for convenient attachment and removal of the dispenser from a display surface, such as a wall. The attachment mechanism includes a generally elongated platform 72 having opposing first surface 72*a* and second surface 72*b*. A raised portion 74 is disposed on a portion of the first surface of the platform. At the area where the raised portion is disposed on the platform, the raised area is narrower in width as compared to the platform. One end of the raised portion has a protrusion 74*a* that, in combination with the first surface of the platform forms a hook like feature 78. The attachment mechanism optionally includes a key 76. In use, the raised portion and the key of the attachment mechanism cooperates with the first and second apertures of the base respectively.

Figure 7:
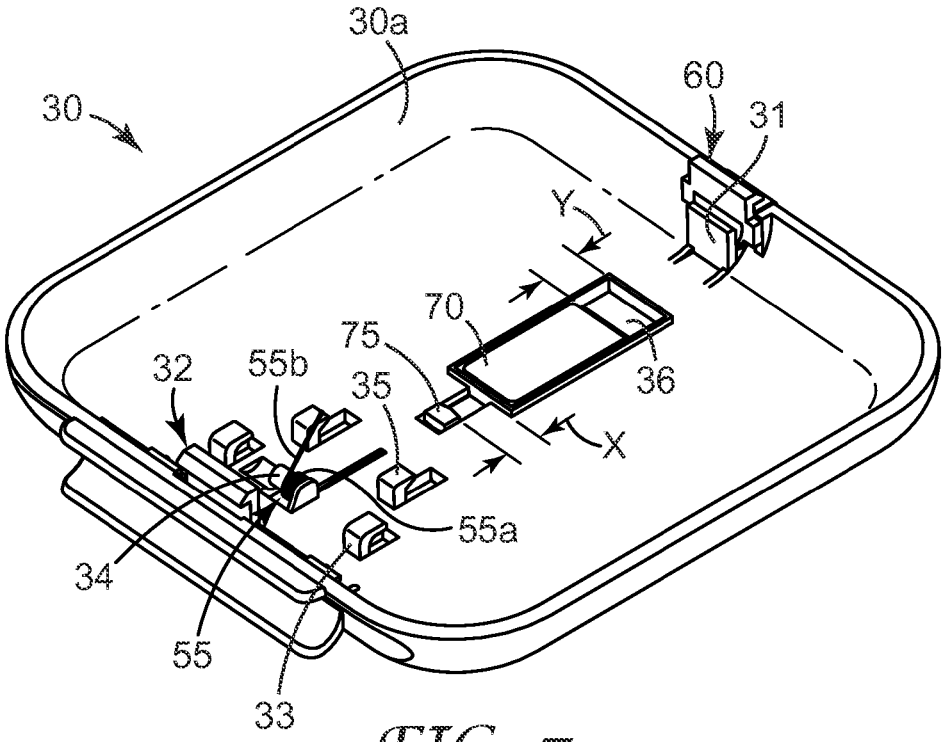
FIG. 7 is a perspective view of the base of FIG. 4 with the attachment mechanism of FIG. 6 assembled therein.

FIG. 7 is a perspective view of the base of FIG. 4 with the attachment mechanism of FIG. 6 installed. As can be seen, the key of the attachment mechanism is located in the second aperture of the base. The key occupies only a portion of the second aperture leaving a gap distance of dimension X. Furthermore, the raised portion of the attachment mechanism is located in the first aperture of the base. The raised portion occupies only a part of the first aperture leaving a gap distance Y. The gap distance X and Y are substantially equal so that when the user slides the dispenser in a direction substantially parallel to its major axis, the key travels from its installed position shown in FIG. 7 to the first wall 39 of the first aperture and the raised portion travels from its installed position shown in FIG. 7 to the second wall 40 of the first aperture thereby causing the dispenser to disengage from the attachment mechanism thus allowing the dispenser to be removed from its display surface.

Figure 8:
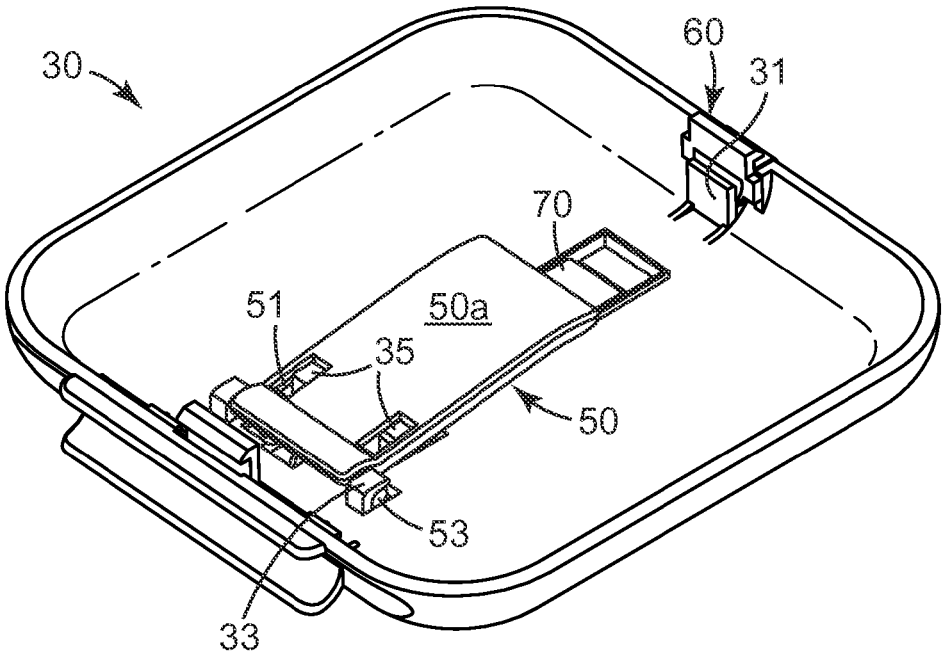
FIG. 8 is a perspective view of the base of FIG. 4 with the biasing mechanism of FIG. 5 and the attachment mechanism of FIG. 6 assembled therein.
Figure 10:
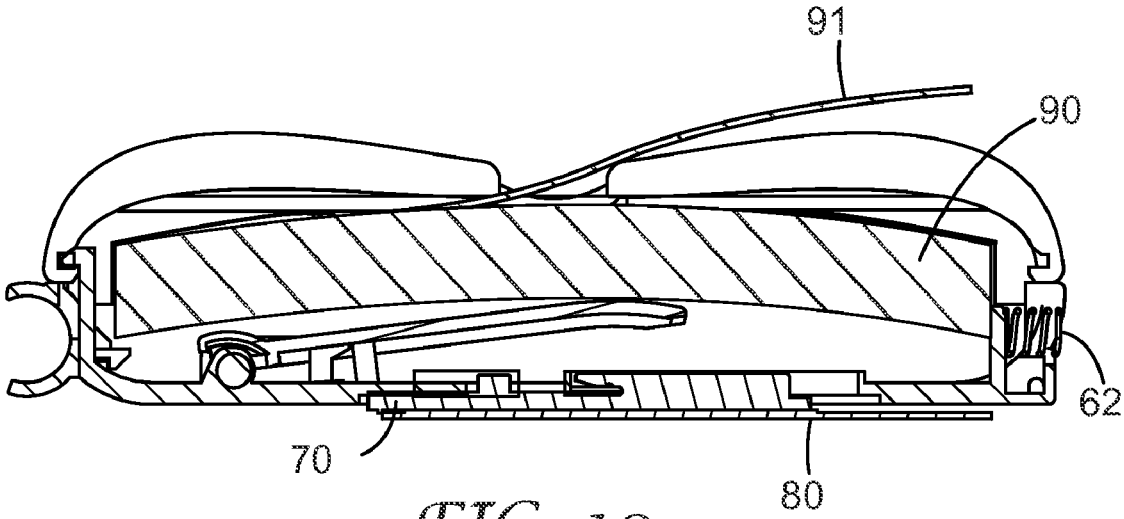
FIG. 10 is a cross-sectional view of the dispenser of FIG. 1 taken along line 9-9 and further includes a pad of repositionable notes installed in the dispenser.

FIG. 8 is a perspective view of the base of FIG. 4 with the biasing mechanism of FIG. 5 and the attachment mechanism of FIG. 6 installed. The placement of the biasing mechanism obscures a portion of the attachment mechanism. The opening 51, disposed near the first end of the paddle, allows the secondary arm 35 of the base to clear through the paddle. The extension 53 of the paddle is hingedly coupled to the first arm 33 of the base. The feet of the distance controlling unit 54 of the paddle catches onto the secondary arm 35 of the base thereby limiting the travel distance of the paddle along the minor axis of the dispenser. When not in use, i.e., when there is no pad of repositionable notes installed in the dispenser and the dispenser is assembled, a portion of the first surface 50*a* of the paddle comes into contact with the ribs 24 of the cover (see FIG. 3). This position can be referred to as an initial position. When a pad of repositionable notes is installed into the dispenser (as shown in FIG. 10), the pad rests on a pad contacting surface 50*a* of the paddle. The weight of the pad forces the paddle to move towards the interior surface of the base. When loaded with the pad, the torsion spring experiences more compressive force as compared to the initial position. As individual notes are dispensed, the weight of the pad is reduced. The torsion spring, however, maintains an upward force pushing against the bottom surface of the paddle thereby pushing the uppermost note in the pad against the ribs located on the interior surface of the cover. In this way, individual notes are available for dispensing until the last note in the pad has been consumed.

Figure 9:
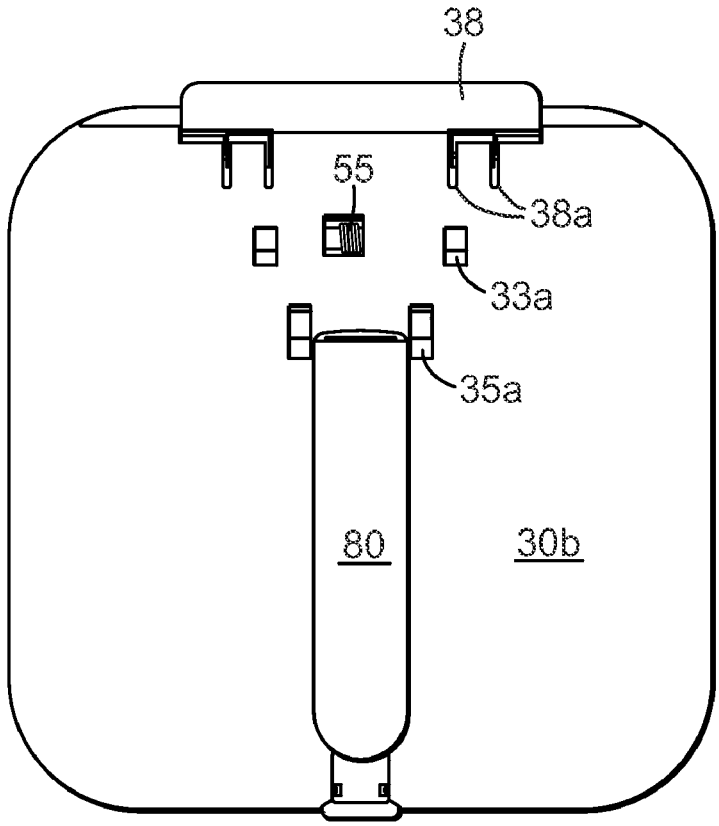
FIG. 9 is a back plan view of the dispenser of FIG. 1.

FIG. 9 is a back plan view of the dispenser of FIG. 1 showing the exterior surface 30*b* of the base and a stretch release adhesive strip 80 with a rounded non-adhesive end tab. Such an adhesive strip includes an adhesive portion, which would adhere to the second surface of the platform, and the end tab extends from one end of the platform. The use of the stretch releasing adhesive strip provides one convenient method of displaying the dispenser to an intended surface, such as without limitation, a vertical wall. Suitable stretch release adhesive strips are commercially available under the Command™ brand, from 3M Company, St. Paul, Minn. Also shown are openings 35*a* associated with the secondary arm 35, openings 32*a* associated with primary arm 33, and openings 38*a* associated with the optional utensil holding device.

FIG. 10 is a cross-sectional view of the dispenser of FIG. 1 taken along line 10-10 with a pad 90 of repositionable notes installed with top note 91 of the pad extending through the slot. The paddle 50 supports the pad with its pad contacting surface touching the bottom most sheet in the pad. The pad has an uppermost note that simultaneously touches the ribs located on the interior surface of the cover and the sheet contact zone of the spacers. The sides of the pad contact the retainers of the spacers, which help minimize pad movement when individual notes are dispensed. This view also shows with better clarity a spring 62 of the spring loaded tab.

In one embodiment, the dispenser of FIG. 1 has the following dimensions: length of 12 cm; rounded corners having a radius of curvature of 2.5 cm; slot length of 10.5 cm with a radius of curvature at the end of the slot of 0.7 cm; height of 3.5 cm at the highest point, as measured from the base. The biasing mechanism has a paddle length of 5.7 cm and a width of 3 cm. This particular dispenser is appropriately sized for a 10.2 cm square (4×4 inch) pad of repositionable notes.

The dispenser can be made of a variety of materials including, plastics, metals, and woods. Suitable plastic materials include, but not limited to, ABS (acrylonitrile-butadiene-styrene polymer) and polystyrene.

Although specific embodiments of the present invention have been shown and described, it is understood that these embodiments are merely illustrative of the many possible specific arrangements that can be devised in application of the principles of the invention. Numerous and varied other arrangements can be devised in accordance with these principles by those of ordinary skill in the art without departing from the spirit and scope of the invention. Thus, the scope of the present invention should not be limited to the structures described in this application, but only by the structures described by the language of the claims and the equivalents of those structures.

What is claimed is:

1. A dispenser for a pad of repositionable notes comprising:

a base having opposing interior and exterior surfaces;

a cover having opposing interior and exterior surfaces and two slots disposed substantially orthogonal to one another, the slots being sized to allow for dispensing individual repositionable notes from the pad, the cover disposed on the base forming a cavity wherein the base and the cover are each polygons having side edges the length of which are substantially equal to one another; and a biasing mechanism disposed in the cavity, said biasing mechanism comprising:

a paddle having opposing pad contacting surface and bottom surface bound by two substantially parallel side walls and an extension protruding from the side walls at a first end of the paddle; and a torsion spring comprising (i) a coil portion having opposing first and second ends, (ii) a first tang extending from the first end of the coil, (iii) and a second tang extending from the second end of the coil, the first tang contacting the bottom surface of the paddle, the second tang contacting the interior surface of the base, the coil portion of the torsion spring disposed on a spindle that extends from the interior surface of the base.

2. The dispenser of claim 1 further comprising a latching mechanism disposed on at least one of the cover and the base.

3. The dispenser of claim 2 wherein the latching mechanism comprises a notch disposed on the interior surface of the cover and a tab disposed on the interior surface of the base, wherein the notch and the tab cooperate to secure the cover to the base.

4. The dispenser of claim 3 comprising a plurality of tabs, at least one of which is a spring-loaded tab.

5. The dispenser of claim 4, wherein the base further comprises a stop in communication with the spring-loaded tab, the stop extending from the interior surface of the base.

6. The dispenser of claim 1, wherein the cover and the base comprise substantially straight side edges connected by rounded corners, each side edge being substantially equal to one another.

7. The dispenser of claim 6 further comprising a plurality of spacers disposed on the interior surface of the cover and disposed near the rounded corners, the spacer having a sheet contact zone disposed between two retainers.

8. The dispenser of claim 1 further comprising a plurality of ribs disposed on the interior surface of the cover adjacent to the two slots.

9. The dispenser of claim 8 wherein the ribs have a length that is substantially equal to the length of the slot.

10. The dispenser of claim 1, wherein the paddle further comprises:

an aperture disposed proximate to the first end of the paddle; and a distance controlling unit extending from the bottom surface of the paddle.

11. The dispenser of claim 1, wherein the distance controlling unit comprises a leg connected to the bottom surface of paddle and a foot extending from a distal end of the leg.

12. The dispenser of claim 11, wherein the base comprises a first arm and a second arm, the first and second arms extending from the interior surface of the base, the first arm hingedly coupled to the extension of the paddle, the second arm in communication with the distance controlling unit.

13. The dispenser of claim 1, wherein each of the two slots is elongated and has rounded ends.

14. The dispenser of claim 1 further comprising a utensil holding device attached to the exterior surface of the base.

15. The dispenser of claim 1 further comprising an attachment mechanism in communication with the base.

16. The dispenser of claim 15, wherein the attachment mechanism comprises:

a platform having opposing first and second surfaces; and a raised portion disposed on the first surface of the platform for engagement with a protrusion disposed in a first aperture of the base.

17. The dispenser of claim 15 further comprising a stretch releasing adhesive strip disposed on the second surface of the platform.

18. The dispenser of claim 15 further comprising a key disposed on the first surface of the platform for engagement with a second aperture disposed in the base.

19. The dispenser of claim 1 wherein the cover, base, and biasing mechanism are formed from polymer based materials.

20. The dispenser of claim 19 wherein the polymer based materials are selected from the group consisting of polystyrene and ABS (acrylonitrile-butadiene-styrene polymer).

21. The dispenser of claim 1 wherein the cover and base are each substantially square and the orientation of the cover to the base can be rotated up to 360° from its initial position in 90° increments.

* * * * *

UNITED STATES PATENT AND TRADEMARK OFFICE

CERTIFICATE OF CORRECTION

PATENT NO. : 7,721,913 B2
APPLICATION NO. : 11/538973
DATED : May 25, 2010
INVENTOR(S) : Nash et al.

It is certified that error appears in the above-identified patent and that said Letters Patent is hereby corrected as shown below:

In the Specification:

Column 3
Line 58; Delete "32a," and insert -- 33a, --, therefor.

Column 5
Line 53; Delete "32a" and insert -- 33a --, therefor.

Signed and Sealed this
Seventeenth Day of September, 2013

Teresa Stanek Rea
*Deputy Director of the UnitedStates Patent and Trademark Office*